US005947283A

United States Patent [19]

Marshall

[11] Patent Number: 5,947,283

[45] **Date of Patent: *Sep. 7, 1999**

[54] FAN BLADE DISPLAY PACKAGE

[76] Inventor: John C. Marshall, 6249 Thibodeaux Rd., Greenwell Springs, La. 70739

[ * ] Notice: This patent is subject to a terminal disclaimer.

[21] Appl. No.: 08/966,872

[22] Filed: Nov. 10, 1997

Related U.S. Application Data

[63] Continuation-in-part of application No. 08/655,098, Jun. 4, 1996, Pat. No. 5,685,426.

[51] Int. Cl.[6] ..... B65D 85/00

[52] U.S. Cl. ..... 206/320; 206/464; 206/471

[58] Field of Search ..... 206/320, 464, 206/471, 321, 461, 462, 463, 465, 466, 467, 468, 469, 470, 776, 782; 53/474, 445, 453

[56] References Cited

U.S. PATENT DOCUMENTS

| | | | |
|---|---|---|---|
| 237,779 | 11/1975 | Lucas . | |
| 2,015,910 | 10/1935 | Schimmel . | |
| 3,217,867 | 11/1965 | Harris . | |
| 3,246,746 | 4/1966 | Holley . | |
| 4,202,694 | 5/1977 | Mayhew . | |
| 4,770,293 | 9/1988 | Craig | 206/471 |
| 4,936,751 | 6/1990 | Marshall | 206/320 |
| 5,027,947 | 7/1991 | Reighart . | |
| 5,029,705 | 7/1991 | Schmidt et al. . | |
| 5,121,835 | 6/1992 | Grupe . | |
| 5,143,215 | 9/1992 | Hartley et al. . | |
| 5,293,993 | 3/1994 | Yates, Jr. et al. | 206/471 |
| 5,485,919 | 1/1996 | Samberg. et al. . | |
| 5,513,745 | 5/1996 | Zoltan et al. . | |
| 5,540,324 | 7/1996 | Knapp | 206/471 |

OTHER PUBLICATIONS

Fantec Inc., Universal ceiling fan blades package, photographs 1,2, & 3.

*Primary Examiner*—Paul T. Sewell
*Assistant Examiner*—Nhan T. Lam
*Attorney, Agent, or Firm*—Liniak, Berenato, Longacre & White, LLC

[57] ABSTRACT

A fan blade display package includes a first and second overlying transparent shells. Each shell has a major dimension and a minor dimension. A recess is formed in each shell for receiving and conforming to at least a first fan blade. The recesses are disposed in offset relation relative to at least one of the dimensions, so that portions of fan blades in each recess are exposed and may be visually perceived through each of the shells.

9 Claims, 3 Drawing Sheets

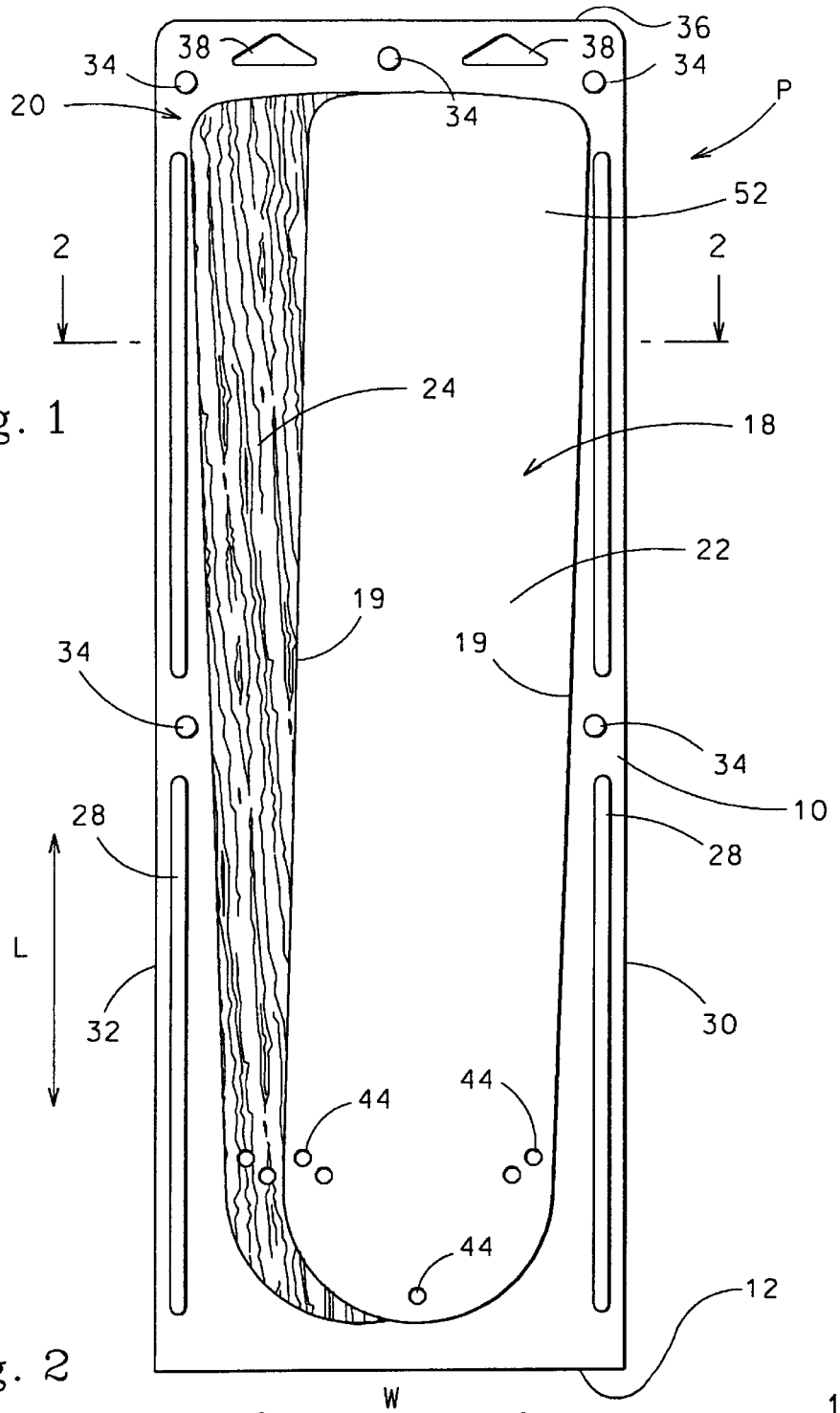
Fig. 1
Fig. 2
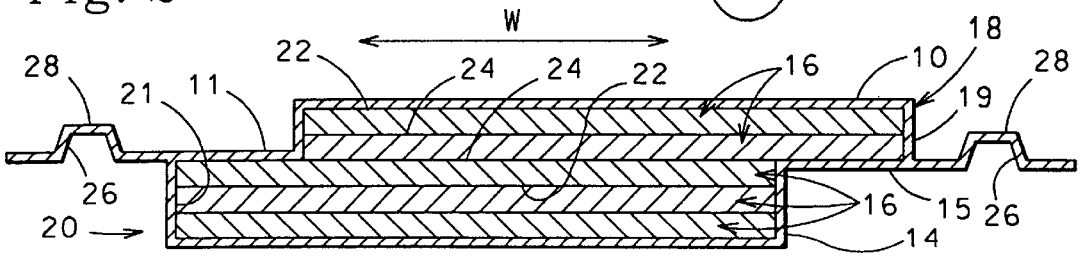

FAN BLADE DISPLAY PACKAGE

This is a continuation of application Ser. No. 08/655,098, filed Jun. 4, 1996, now U.S. Pat. No. 5,685,426.

FIELD OF THE INVENTION

The disclosed invention is to a package for displaying at least two physically similar but dissimilarly colored or ornamented articles, a substantial portion of each of which may be visually observed from either major surface of the package. More particularly, the invention is to a clamshell package for ceiling fan blades, in which each blade is received in a recess and the recesses are offset so that a substantial portion of each ceiling fan blade may be viewed through either shell of the package.

BACKGROUND OF THE INVENTION

Ceiling fans typically have four or five equiangularly disposed blades which rotate about a center axis. Each blade typically is mounted to a blade arm, which is secured to a rotary shaft. My Pat. No. 4,936,751, the disclosure of which is incorporated herein by reference, discloses a fan blade mount for securing the fan blade to the rotary shaft. Consumers on occasion have a need or desire to replace the fan blades. It is to be understood that each fan blade has first and second oppositely disposed major surfaces, only one of which normally may be perceived because of the elevated position of the ceiling fan. Because only one major surface of a blade normally may be observed, then the other non-observed major surface may have an appearance which differs from the observed surface. It has been customary for replacement blades to be sold in sets. Typically the package containing the blades is formed of a transparent plastic material, so that the consumer can observe the color or surface marking in order to select an appropriate fan blade.

Because only one major surface of the blades is viewable when mounted to the fan, then the other major surface may be dissimilarly colored, ornamented or patterned.

It has been the practice heretofore for the set of blades sold as replacements to be arrayed in a stack when in the package. When in the stack, then the blades are arrayed so that one major surface is viewable from a first side of the package, while the other major surface is viewable through the other side. In this way a consumer observing the first surface will be aware of the color, and may then turn over the package to observe the other color. The package does not permit the consumer to observe both major surfaces at the same time, so the consumer may not be aware that the other major surface is differently colored. Because the packages are relatively bulky, then it is inconvenient for the consumer to be able to look through more than a few packages.

Even should the consumer be aware that the other major surface is dissimilarly colored, then the package still needs to be turned or rotated in order to permit the other major surface to be observed. Turning the package may be difficult to accomplish, particularly if a plurality of packages are hung together on a hook. Should the consumer wish to observe the last package on the hook, then it may be necessary to remove all of the packages from the hook in order to access that one. Not only may this be more effort than the consumer wishes to expend, but there then is the need for the consumer, or retail personnel, to replace the other packages.

Retailers today are constantly seeking ways to increase sales while minimizing costs. The prior package is relatively expensive because of the need to have the package rehung, and also because additional packages are necessary to compensate for the consumer's failure to recognize that each package has blades with different colors or surface ornamentation. Not only does this require additional inventory, but also additional display space. Thus costs are increased, while not necessarily optimizing sales.

In view of the above, those skilled in the art will understand that there is a need for a display package permitting a consumer to observe a substantial portion of each of the major surfaces of ceiling blade fans in a stack, in order to facilitate retail purchase while minimizing consumer inconvenience and retailer costs. The disclosed invention meets these and other needs in the art by providing a clamshell package formed of two overlying transparent shell members, each of which has a recess in which ceiling blade fans are received. The recesses are offset relative to each other, so that a substantial portion of each major surface of the blades may be observed through either shell, thus permitting the consumer to observe the major surfaces without a need to rotate or remove the package.

SUMMARY OF THE INVENTION

A fan blade display package according to the invention includes first and second overlying transparent shells. Each shell has a major dimension and a minor dimension. A recess is formed in each shell for receiving and conforming to at least a first fan blade. The recesses are disposed in offset relation relative to at least one of the dimensions. Because of the offset disposition of the recesses, then portions of at least one fan blade in each recess are exposed and may be visually perceived through each of the shells.

A fan blade display package includes first and second transparent overlying shells. The shells have corresponding major and minor dimensions. A recess is formed in each shell for receiving and conforming to at least a first fan blade. A fan blade is positioned in each recess, so that the blades overlie in a stack. The recesses are disposed in offset relation relative to at least one of the dimensions. A portion of the fan blade in the first shell recess may be visually perceived through the second shell, while the fan blade in the second shell recess also may be visually perceived therethrough.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a top plan view of a first embodiment of the display package of the invention;

FIG. 2 is a cross-sectional view taken along the line 2—2 of FIG. 1;

DETAILED DESCRIPTION OF THE INVENTION

Figure 3:
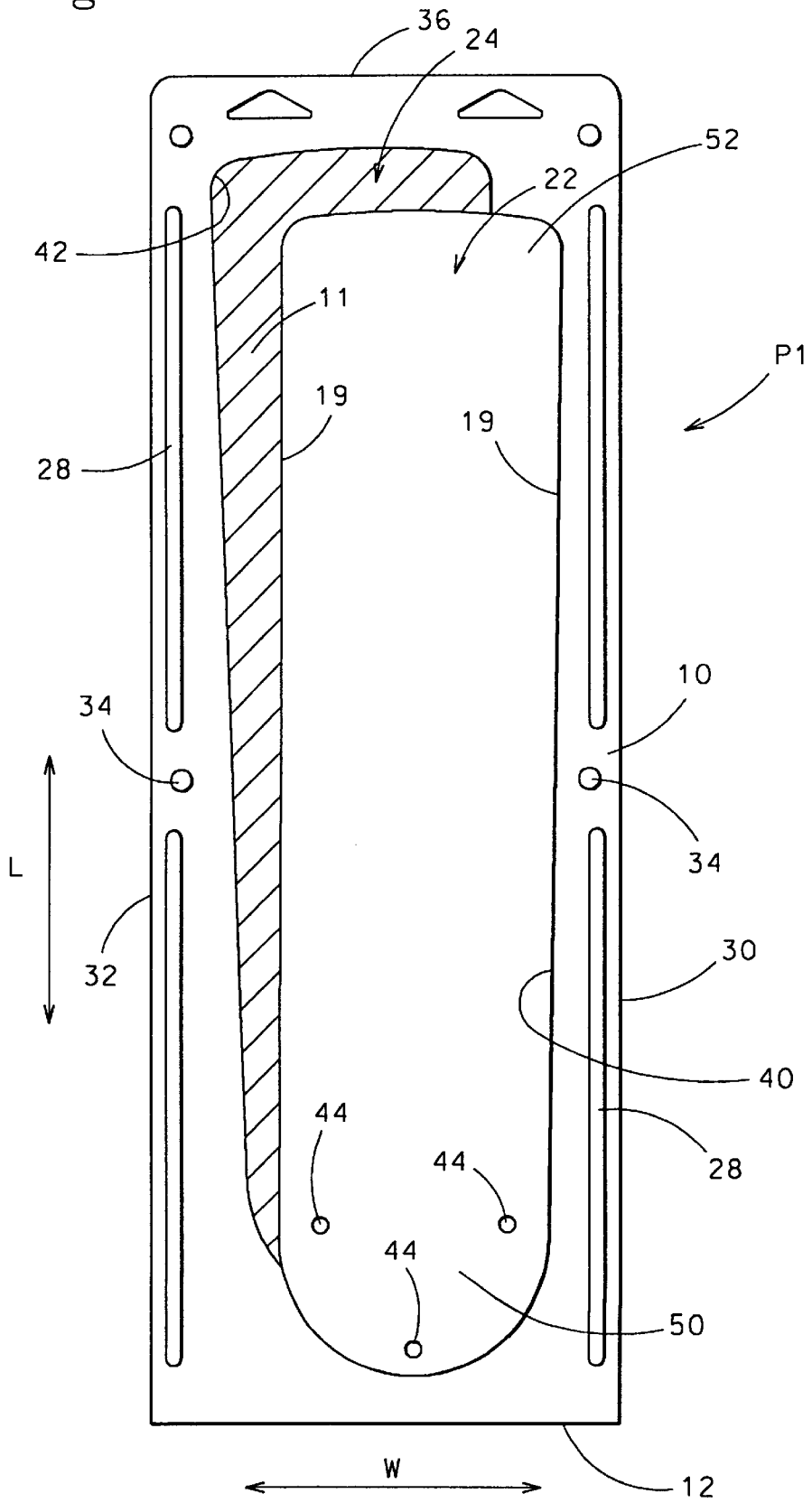
FIG. 3 is a top plan view of a second embodiment of the package of the invention.

Clamshell package P, as best shown in FIGS. 1 and 2, includes a first transparent shell 10 hingedly connected at 12 to second transparent shell 14. I prefer that the shells 10 and 14 of the package P be manufactured from a transparent polymeric material. Use of a transparent material permits optimum viewing of the contents of the package. Polymeric material is utilized because it may be vacuum-formed, while also permitting hinged action at 12.

Each of the shells 10 and 14 is rectangular in plan. The shells 10 and 14 have corresponding dimensions. Each shell has a major or length dimension L, and a minor or width dimension W. The shells 10 and 14 are sized to accommodate fan blades 16, and preferably five fan blades 16 form a set contained within the package P. Those skilled in the art will understand that package P may contain more or fewer fan blades 16 than five, depending upon the blades or the fan manufacturer. Additionally, while I prefer that the package P be used to display ceiling fan blades, it may be used with other sorts of articles where there is a need or desire to permit a consumer to observe more than one item at a time.

As best shown in FIG. 2, and as can be appreciated from FIG. 1, shell 10 has a recess 18 formed therein in a shape conforming to the shape of the fan blades 16. Preferably the recess 18 has a depth sufficient to receive two fan blades 16 as a result of peripheral wall 19. Shell 14, on the other hand, has a recess 20 which likewise conforms to the shape of blades 16, and which has a depth sufficient to accommodate three fan blades 16 in view of peripheral wall 21. Thus the blades 16 in package P overlie and form a stack. The recesses 18 and 20, as best shown in FIG. 2, overlie to a large extent, although the recesses 18 and 20 are offset relative to the minor or width dimension W. Thus shell portion 11 overlies the uppermost blade 16 in recess 20, while shell portion 15 underlies the lowermost blade 16 in recess 18. Because of the offset disposition of the recesses 18 and 20, then a portion of the outermost one of the ceiling blades 16 in the recess 20 may be observed through the transparent shell 10, while at the same time permitting the entirety of the outermost one of the ceiling blades 16 in the recess 18 to be observed, as best shown in FIG. 1.

Each of the ceiling fan blades 16 has oppositely disposed major surfaces 22 and 24. The major surfaces 22 and 24 of the blades 16 in the package P typically are differently colored or have different surface ornamentation. Thus, the major surface 22, for example, may have a white color, while the major surface 24, for example, may have a wood grain pattern. Because of the offset orientation of the recess 18 relative to the recess 20, then a consumer observing first shell 10 may quickly and readily ascertain the coloring and surface ornamentation of the major surfaces 22 and 24 of the ceiling fan blades 16 in the stack. Moreover, because the recess 20 is laterally shifted relative to the recess 18, then the consumer may observe an uninterrupted portion of the surface 24 under shell portion 11, and thereby recognize that the entirety of the surface 24 has the wood grain pattern which is observed. While I illustrate a wood grain pattern on the surface 24, those skilled in the art will recognize that the surface ornamentation may be essentially any color, pattern, decoration, illustration, or ornamentation which a consumer may desire.

Because the package P is a clamshell package, having the shells 10 and 14 folded about hinge 12, then I provide a tongue and groove connection for releasably securing together shells 10 and 14. Thus, tongues 26 extend from shell 14 and are lockingly received within grooves 28 formed in shell 10 as best shown in FIG. 2. The tongues 26 and grooves 28 are disposed adjacent lateral edges 30 and 32 of the package P, and span a substantial distance there along. Interposed between adjacent pairs of tongues 26 and grooves 28 are clamps 34 formed in first shell 10 for receiving locking buttons (not shown) extending from shell 14. Similar clamps 34 and buttons may also be provided at upper edge 36 to seal the package P. While I prefer tongue and groove securing means, the shells 10 and 14 may be otherwise secured, such as with adhesive, hot sealing, or by peripheral bonding. The package P may have cut-outs 38 formed in the shells 10 and 14 in order to facilitate the package P being hung on a hook for display to the consumer.

Figure 4:
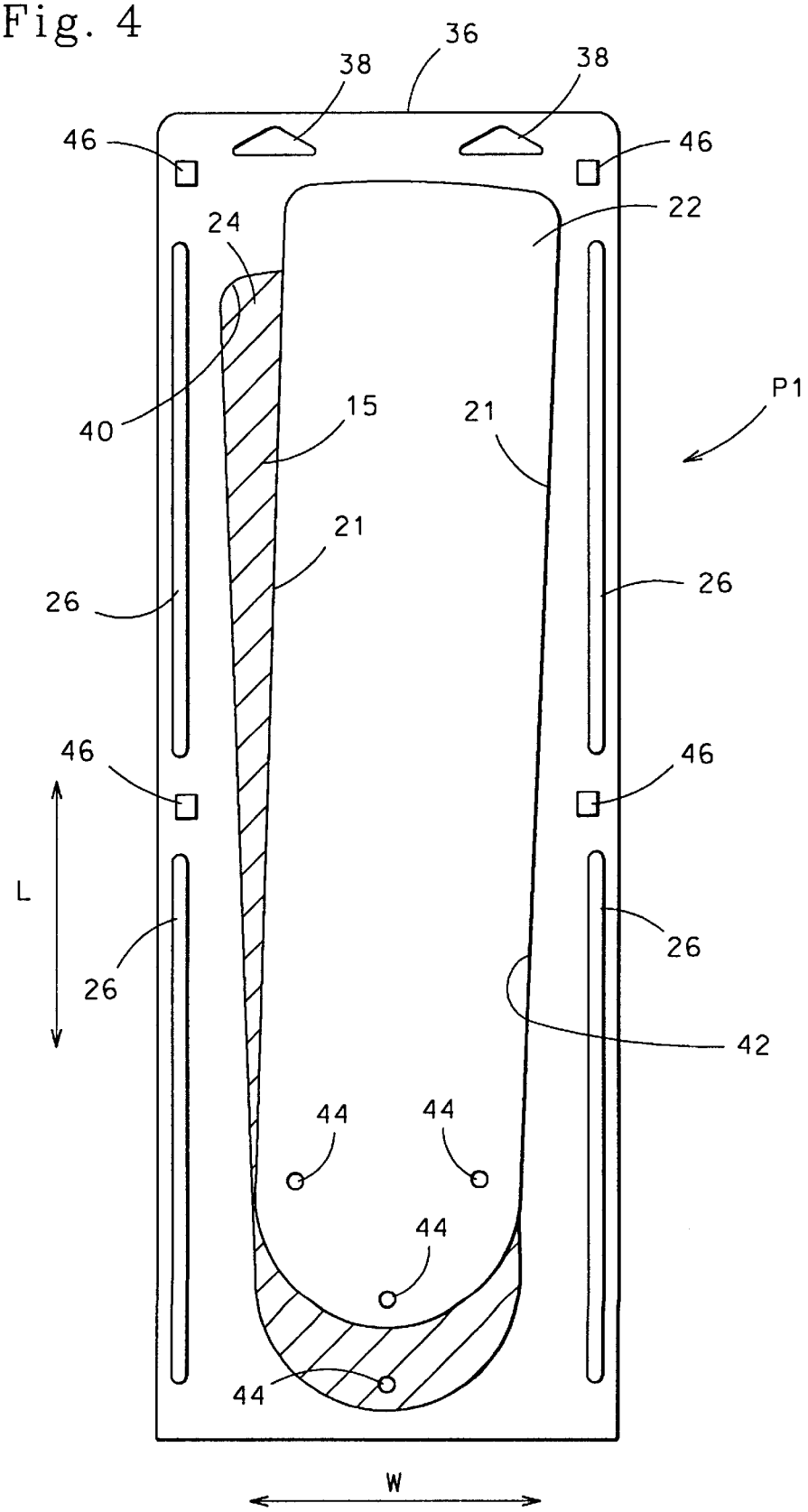
FIG. 4 is a bottom plan view of the package of FIG. 3.

Package P1 is best shown in FIGS. 3 and 4. As with the package P, package P1 is a clamshell package of a form generally shown in FIG. 1, so like reference numbers relate to like components. The package P1 differs from the package P essentially in the offset orientation of the recesses. Shell 10 of package P1 of FIG. 3 has recess 40 for receiving two ceiling fan blades 16, with a recess 42 being formed in shell 14 for receiving three ceiling fan blades. Likewise, as best shown in FIG. 4, recess 42 formed in shell 14 is offset relative to the recess 40 formed in shell 10.

Unlike the package P of FIGS. 1–2, the recesses 40 and 42 of the package P1 are offset in both the major dimension L and the minor dimension W. Because of the offset in the major dimension L, then, as best shown in FIG. 4, the heels 50 of the blades 16 contained within the recesses 40 and 42 are longitudinally aligned, as can be seen from the alignment of mounting holes 44, whereas the toe portions 52 at the opposite end of the package P1 adjacent edge 36 are offset in the width dimension W. Thus the fan blades 16 are fanned out in an array, as are the fan blades 16 of package P. Also illustrated in FIG. 4 are the square buttons 46 which are received within the circular clamps 34.

Because the recesses 40 and 42 of the package P1 are offset relative to each other in both the major dimension L and the minor dimension W, then a consumer will be able to visually observe the major surfaces 22 and 24 upon confronting either the shell 10 or the shell 14. Thus, as best shown in FIG. 3, a consumer confronting the package P1 and facing the shell 10 will be able to observe the surface 24 of the outermost blade 16 positioned within the recess 42 of shell 14, while also being able to visually observe the entire surface 22 of the outermost blade 16 received within recess 40. The consumer thus should be able to ascertain not only the respective surface ornamentations on the surfaces 22 and 24, but also that the ornamentation extends over the entirety of each such surface. Similarly, should the consumer instead confront the shell 14, then again the entirety of one of the surfaces, in this case the surface 22, will be observed through the shell 14 while also being able to observe a substantial portion of the surface 24 of the blade 16 in the recess 40 of the underlying shell 10. Because the recesses 40 and 42 are offset also in the major dimension L, then the consumer will observe that the heel portion of the blade 16 in the recess 40 has the same ornamentation as that portion which may be observed along the side edge. Thus the consumer should be able to appreciate that the entirety of the surface 24 has the observed ornamentation.

Because the packages P and P1 permit a consumer to observe both major surfaces of the blades 16 regardless of which shell 10 or 14 is facing the consumer, then the consumer may more easily select a package containing appropriate blades 16. Retailer costs should be reduced because there is less need to have personnel rehang packages removed by a consumer, while also reducing inventory needs and display space. Thus the available space is more efficiently utilized.

While this invention has been described as having a preferred design, it is understood that it is capable of further modifications, uses, and/or adaptations following the general principle of the invention, and including such departures from the present disclosure as come within known or customary practice in the art to which the invention pertains, and as may be applied to the central features hereinbefore set forth, and fall within the scope of the invention of the limits of the appended claims.

What I claim is:

1. A method for packaging fan blades comprising the steps of:

placing at least a first fan blade in a first recess of a first transparent shell;

placing at least a second fan blade in a second recess which is formed in a second transparent shell; and securing together said first and second transparent shells in an overlying manner so that said at least a first fan blade and said at least a second fan blade are offset with respect to one another, whereby portions of said at least a first fan blade and said at least a second fan blade in each recess are exposed and may be visually perceived through each of said transparent shells.

2. The method of claim 1, wherein said step of securing is performed so that said at least a first fan blade and said at least a second fan blade are both longitudinally and laterally offset with respect to one another.

3. The method of claim 1, wherein said step of securing is performed so that said at least a first fan blade is longitudinally offset with respect to said at least a second fan blade.

4. The method of claim 1, wherein said step of securing is performed so that said at least a first fan blade and said at least a second fan blade are laterally offset with respect to one another.

5. The method of claim 1, wherein said step of securing is performed in a subsequently releasable manner.

6. The method of claim 1, wherein said step of securing includes lockingly inserting a plurality of tongues extending from one of said shells, into a plurality of cooperating grooves formed in the other of said shells.

7. The method of claim 1, wherein said at least a first fan blade and said at least a second fan blade are substantially identical and each has a first major surface carrying a first type of ornamentation and an opposing major surface carrying a second type of ornamentation, and wherein said step of placing at least a first fan blade into said first recess and said step of placing at least a second fan blade in said second recess are performed so that said first type of ornamentation and said second type of ornamentation are visually perceivable through both of said shells.

8. The method of claim 1, wherein said at least a first fan blade and said at least a second fan blade are substantially identical and each has a first major surface of a first color and an opposing major surface of a second color, and wherein said step of placing at least a first fan blade into said first recess and said step of placing at least a second fan blade in said second recess are performed so that both of said first and second colors on said first and opposing major surfaces are visually perceivable through both of said shells.

9. The method of claim 1, wherein said step of securing the shells together is performed so that the shells are hingedly interconnected.

* * * * *